US009890722B2

(12) United States Patent
Tsuji et al.

(10) Patent No.: US 9,890,722 B2
(45) Date of Patent: Feb. 13, 2018

(54) FUEL INJECTION CONTROL METHOD FOR INTERNAL COMBUSTION ENGINE

(71) Applicant: HONDA MOTOR CO., LTD., Tokyo (JP)

(72) Inventors: Kanta Tsuji, Saitama-ken (JP); Takaaki Fukusako, Saitama-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 171 days.

(21) Appl. No.: 14/484,500

(22) Filed: Sep. 12, 2014

(65) Prior Publication Data

US 2015/0006061 A1 Jan. 1, 2015

Related U.S. Application Data

(62) Division of application No. 13/173,654, filed on Jun. 30, 2011, now abandoned.

(30) Foreign Application Priority Data

Jul. 22, 2010 (JP) ..... 2010-164667

(51) Int. Cl.

*F02D 41/30* (2006.01)
*F02D 41/00* (2006.01)
*F02D 41/06* (2006.01)

(52) U.S. Cl.

CPC ..... *F02D 41/008* (2013.01); *F02D 41/009* (2013.01); *F02D 41/062* (2013.01); *F02D 41/30* (2013.01); *F02D 2041/0092* (2013.01)

(58) Field of Classification Search

CPC .... F02D 41/008; F02D 41/009; F02D 41/062; F02D 41/30; F02D 13/0203;

(Continued)

(56) References Cited

U.S. PATENT DOCUMENTS 4,346,682 A 8/1982 Mader
4,421,075 A 12/1983 Mandel (Continued)

FOREIGN PATENT DOCUMENTS

EP 1881188 1/2008
JP 06-173746 6/1994

(Continued)

OTHER PUBLICATIONS

Japanese Office Action for corresponding JP Application No. 2010-164667, dated Jul. 23, 2013.

*Primary Examiner* — Hai Huynh
*Assistant Examiner* — Gonzalo Laguarda
(74) *Attorney, Agent, or Firm* — Mori & Ward, LLP

(57) ABSTRACT

A fuel injection control method for an internal combustion engine includes instantaneous injection that injects fuel to a predetermined cylinder is executed immediately when it is determined that a predetermined condition is satisfied after cranking of the engine is started. A leaning influence ratio which is a ratio of a time period during which vaporized fuel supplied to the predetermined cylinder becomes lean to a instantaneous injection time period which is a time period over which fuel is injected by the instantaneous injection is estimated. A threshold value is set based on temperature of the engine. When the leaning influence ratio is larger than the threshold value, the instantaneous injection is inhibited.

5 Claims, 8 Drawing Sheets

(58) Field of Classification Search
CPC ..... F02D 13/0207; F02D 13/0211; F02D 13/0215; F02D 13/0219; F02D 13/0223; F02D 13/0226; F02D 13/023; F02D 13/0234; F02D 13/0238
USPC ..... 701/103, 110; 123/431, 142.5 R, 179.15, 123/179.16, 179.4, 481, 520, 90.15, 345, 123/346, 347, 348; 60/286, 285, 297
See application file for complete search history.

(56) References Cited

U.S. PATENT DOCUMENTS

| | | | | |
|---|---|---|---|---|
| 5,284,117 | A | 2/1994 | Akase | |
| 6,223,730 | B1 * | 5/2001 | Hasegawa | F02D 41/047 123/491 |
| 6,341,487 | B1 | 1/2002 | Takahashi et al. | |
| 7,500,469 | B2 * | 3/2009 | Akita | B60K 6/445 123/431 |
| 7,891,335 | B2 | 2/2011 | Fukusako | |
| 8,594,905 | B2 | 11/2013 | Shiomi et al. | |
| 2011/0295490 | A1 | 12/2011 | Tsuji et al. | |
| 2012/0330535 | A1 | 12/2012 | Tsuji et al. | |

FOREIGN PATENT DOCUMENTS

| | | |
|---|---|---|
| JP | 2002-161783 | 6/2002 |
| JP | 3856091 B2 | 12/2006 |
| WO | WO 2006/043679 | 4/2006 |
| WO | WO 2006/064980 | 6/2006 |
| WO | WO 2006/075726 | 7/2006 |

* cited by examiner

FUEL INJECTION CONTROL METHOD FOR INTERNAL COMBUSTION ENGINE

CROSS-REFERENCE TO RELATED APPLICATIONS

The present application is a divisional application of U.S. patent application Ser. No. 13/173,654, filed Jun. 30, 2011 which claims priority based on Japanese Patent Application No. 2010-164667, filed Jul. 22, 2010. The contents of these applications are incorporated herein by reference in their entirety.

BACKGROUND OF THE INVENTION

Field of the Invention

The present invention relates to a fuel injection control method for an internal combustion engine.

Description of the Related Art

Conventionally, a fuel injection control system for an internal combustion engine of this kind has been proposed in Japanese Patent No. 3856091. This engine is of a four-cycle type, and includes a plurality of cylinders and intake port injection-type fuel injection valves provided for the cylinders, respectively. In this fuel injection control system, when the engine is started, first injection of fuel from the respective fuel injection valves is controlled as follows: After an ignition switch is turned on, when the determination of strokes in the respective cylinders is terminated, in order to promptly start the engine, fuel is instantaneously injected (hereinafter referred to as the "instantaneous injection") from the fuel injection valve in an intake stroke at that time (hereinafter referred to as the "instantaneous injection cylinder"). On the other hand, from the other fuel injection valves, fuel is injected in an exhaust stroke.

Further, an amount of fuel injected by the above-mentioned instantaneous injection is calculated, timing of start of the instantaneous injection is set to predetermined timing in the intake stroke, and timing of termination of the instantaneous injection is calculated according to the calculated fuel injection amount and the set start timing. Then, when the calculated timing of termination of the instantaneous injection exceeds a predetermined retard limit, the instantaneous injection is inhibited. This is for the following reason: If the instantaneous injection is performed in the timing beyond the retard limit, all of the injected fuel does not flow into the instantaneous injection cylinder, whereby air-fuel mixture within the instantaneous injection cylinder becomes lean, which may cause a misfire, so that the instantaneous injection is inhibited to prevent this problem.

However, in the conventional fuel injection control system, when the timing of termination of the instantaneous injection exceeds the retard limit, the instantaneous injection is inhibited as mentioned above, and the retard limit is set to a predetermined fixed value. For this reason, irrespective of whether the amount of fuel injected by the instantaneous injection is large or small, when the termination timing exceeds the retard limit, the instantaneous injection is always inhibited. Therefore, in the conventional fuel injection control system, the instantaneous injection is sometimes unnecessarily inhibited, and in this case, it is not possible to properly perform prompt engine starting.

Further, when the timing of start of the instantaneous injection is later than proper timing, causing total retardation of a time period for injection of fuel by the instantaneous injection, the vaporization characteristics of fuel injected by the instantaneous injection change, which may cause a misfire. However, the conventional fuel injection control system merely sets the retard limit to a fixed value, and hence it is difficult to prevent such a misfire.

In addition, in the conventional fuel injection control system, the instantaneous injection is performed in the intake stroke, and fuel injection with respect to a cylinder to which fuel is supplied next to the instantaneous injection cylinder (hereinafter referred to as the "second supplied cylinder") is performed in the exhaust stroke. By this operation, fuel is sometimes simultaneously injected to the instantaneous injection cylinder and the second supplied cylinder, and in that case, pressure of the fuel supplied to the respective fuel injection valves provided in both the cylinders becomes lower than that in a case where fuel is injected to a single cylinder. As a consequence, the degree of atomization of fuel injected by the instantaneous injection is lowered, which also causes the injected fuel to flow into the instantaneous injection cylinder without being sufficiently vaporized. Further, the above-mentioned lowered fuel pressure reduces the amount of fuel injected by the instantaneous injection, resulting in a reduced amount of fuel actually supplied to the instantaneous injection cylinder.

As described above, in the conventional fuel injection control system, the amount of fuel actually supplied to the instantaneous injection cylinder decreases, and the fuel is supplied to the instantaneous injection cylinder in a state where the vaporization characteristics thereof are low, whereby the amount of vaporized fuel supplied to the instantaneous injection cylinder in an actually vaporized state decreases, and as a result, there is a fear that the supplied vaporized fuel is not burned, causing a misfire. In that case, it is impossible to properly perform prompt engine starting, and the vaporized fuel is directly discharged as exhaust gases, which increases exhaust emissions. Further, since the fuel is supplied to the instantaneous injection cylinder without being sufficiently vaporized, the air-fuel mixture within the instantaneous injection cylinder is not sufficiently homogenized, and as a result, HC as unburned fuel component increases, which also increases exhaust emissions.

SUMMARY OF THE INVENTION

According to one aspect of the present invention, a fuel injection control method for an internal combustion engine in which fuel injected by fuel injection valves is supplied to cylinders, includes detecting temperature of the engine; and determining whether or not a predetermined condition necessary for injecting fuel from the fuel injection valves is satisfied; executing instantaneous injection that injects fuel to a predetermined cylinder to which fuel is to be supplied from an associated one of the fuel injection valves immediately when it is determined that the predetermined condition is satisfied after cranking of the engine is started; setting an instantaneous injection time period which is a time period over which fuel is to be injected by the instantaneous injection;

estimating a leaning influence ratio which is a ratio of a time period during which an amount of vaporized fuel to be supplied to the predetermined cylinder in an actually vaporized state decreases to the set instantaneous injection time period; setting a threshold value based on the detected temperature of the engine; and inhibiting the instantaneous injection when the estimated leaning influence ratio is larger than the set threshold value.

Further, the instantaneous injection time period which is a time period over which fuel is injected by the instantaneous injection is set, and the leaning influence ratio which is a ratio of the time period during which vaporized fuel supplied to the predetermined cylinder becomes lean to the set instantaneous injection time period is estimated. Further, the threshold value is set based on the detected temperature of the engine, and when the estimated leaning influence ratio is larger than the set threshold value, the instantaneous injection is inhibited. Note that as an amount of fuel supplied to a cylinder decreases, or fuel is supplied to a cylinder without being vaporized, an amount of vaporized fuel actually supplied to the cylinder in a vaporized state decreases.

DETAILED DESCRIPTION OF PREFERRED EMBODIMENTS

Figure 1:
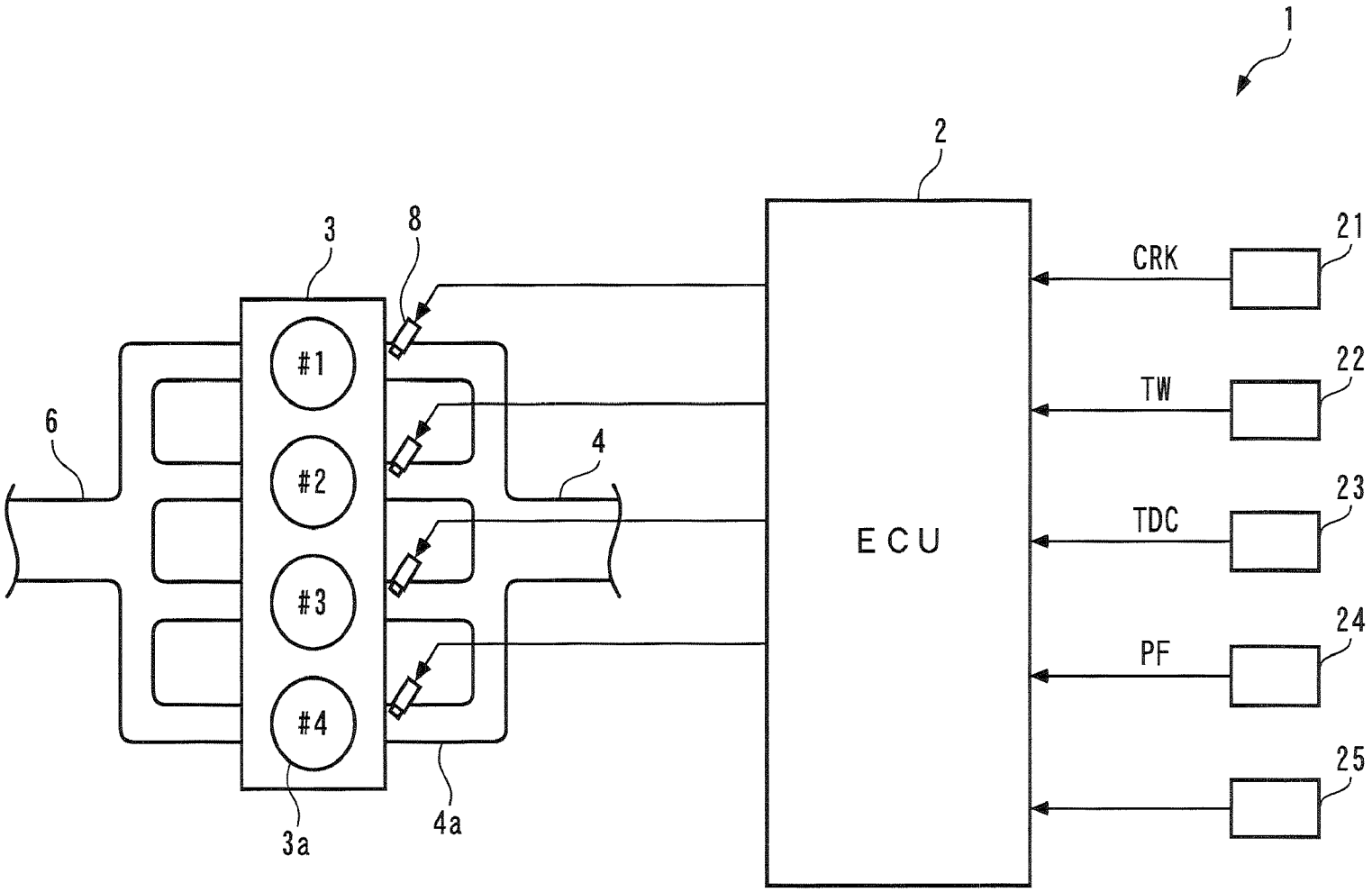
FIG. 1 is a diagram schematically illustrating a fuel injection control system according to a first embodiment of the present invention, and an internal combustion engine to which the fuel injection control system is applied.

Hereafter, a description will be given of a first embodiment of the present invention with reference to drawings. A fuel injection control system 1 according to the first embodiment is for controlling fuel injection in an internal combustion engine (hereinafter referred to as the "engine") 3 shown in FIGS. 1 and 2, and includes an ECU 2. The ECU 2 will be described in detail hereinafter.

Figure 2:
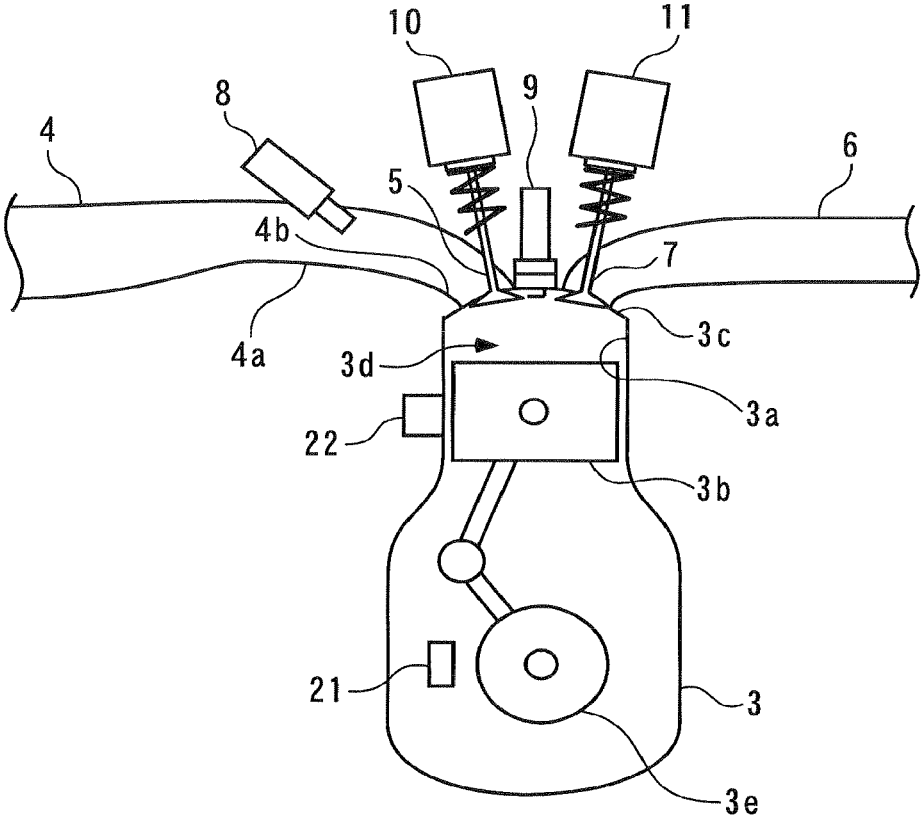
FIG. 2 is a schematic cross-sectional view of part of the engine.

The engine 3 is a gasoline engine of a four-cycle type, which has four cylinders 3*a* of #1 to #4 (only one of which is shown in FIG. 2), and is installed on a vehicle (not shown). Each of the cylinders 3*a* of the engine 3 is provided with a piston 3*b*, and a combustion chamber 3*d* is formed between the piston 3*b* and a cylinder head 3*c* within each cylinder 3*a* (only one of each of which is shown). Note that in FIG. 1, only reference numeral of the cylinder 3*a* corresponding to the #4 cylinder 3*a* is illustrated, and reference numerals of other cylinders 3*a* are omitted, for convenience sake.

As is well known, in the engine 3, one combustion cycle is completed by the four strokes of an intake stroke, a compression stroke, an expansion stroke, and an exhaust stroke in each cylinder 3*a*. In the present embodiment, these four strokes are defined as follows:

intake stroke: a stroke for performing an intake operation for drawing intake, represented by a section corresponding to of a rotational angle 180° of a crank shaft 3*e* (hereinafter referred to as the "crank angle") over which the piston 3*b* is moved from a TDC position to a BDC position;

compression stroke: a stroke for performing a compression operation for compressing intake air drawn by the intake operation, represented by a section corresponding to a crank angle of 180° over which the piston 3*b* is moved from the BDC position to the TDC;

expansion stroke: a stroke for performing an expansion operation for burning and expanding intake air compressed by the compression operation, represented by a section corresponding to a crank angle of 180° over which the piston 3*b* is moved from the TDC position to the BDC position; and exhaust stroke: a stroke for performing an exhaust operation for discharging burned gasses generated by the expansion operation, represented by a section corresponding to a crank angle of 180° over which the piston 3*b* is moved from the BDC position to the TDC position.

The body of the engine 3 is provided with a crank angle sensor 21 and a coolant temperature sensor 22. The crank angle sensor 21 is of an electromagnetic pickup type, and comprises a first rotor coaxially fixed to the crankshaft 3*e* and a first pickup disposed in the vicinity of the first rotor. Further, the crank angle sensor 21 generates a CRK signal, which is a pulse signal, along with rotation of the crankshaft 3*e*, and delivers the CRK signal to the ECU 2.

Each pulse of the CRK signal is basically generated whenever the crankshaft 3*e* rotates through a predetermined first crank angle (e.g. 6°), and is generated at pulse intervals slightly larger than those of the predetermined first crank angle at the end of the compression stroke and at the end of the exhaust stroke in the #1 cylinder 3*a*. The ECU 2 calculates rotational speed (hereinafter referred to as the "engine speed") NE of the engine 3 based on the CRK signal.

Further, the coolant temperature sensor 22, which is formed by a thermistor, detects the temperature of engine coolant (hereinafter referred to as the "engine coolant temperature") TW circulating through a cylinder block of the engine 3, and delivers a signal indicative of the sensed engine coolant temperature TW to the ECU 2.

The engine 3 further has an intake passage 4 and intake valves 5 for drawing intake air into the cylinder 3*a*, and an exhaust passage 6 and exhaust valves 7 for discharging burned gasses generated by combustion, fuel injection valves 8 for supplying fuel, and spark plugs 9 for igniting an air-fuel mixture in the combustion chambers 3*d*. The intake valves 5, the exhaust valves 7, the fuel injection valves 8, and the spark plugs 9 are provided on a cylinder 3*a*-by-cylinder 3*a* basis.

The intake passage 4 branches into four passages at an intake manifold 4*a* at a downstream end of the intake passage 4, and is connected to the cylinder heads 3*c* via the intake manifold 4*a*, for communication with the #1 to #4 cylinders 3*a*. Further, the engine 3 is provided with an intake-side valve-operating mechanism 10 for driving the intake valves 5. The intake-side valve-operating mechanism 10 is of a cam driven type including an intake cam (not shown). The intake cam is connected to the crank shaft 3*e*, and rotates once whenever the crank shaft 3*e* rotates twice. The drive force of the crank shaft 3*e* is transmitted e.g. via the intake cam, whereby the intake valves 5 are opened and closed. A timing TOPINV at which the intake valve 5 start to be opened (hereinafter referred to as the "intake valve opening timing") is set to a predetermined timing (see FIG. 4) immediately before the end of the exhaust stroke of the associated one of the cylinders 3*a*, and is represented by a crank angle position with reference to a point (=0°) at which the compression stroke of the associated cylinder 3*a* is started.

Further, the intake cam is provided with a cam angle sensor 23. The cam angle sensor 23 is of an electromagnetic pickup type similarly to the crank angle sensor 21, and comprises a second rotor coaxially fixed to the intake cam and a second pickup provided in the vicinity of the second rotor (none of which is shown). Further, the cam angle sensor 23 generates a TDC signal, which is a pulse signal, along with rotation of the intake cam, and delivers the TDC signal to the ECU 2.

The TDC signal rises at the end of the compression stroke of the #1 cylinder 3*a*, then falls at the end of the following expansion stroke, and rises immediately before the start of the following exhaust stroke. Then, the TDC signal falls at the end of the exhaust stroke, then rises at the end of the following intake stroke, and then falls immediately before the start of the following compression stroke.

The exhaust passage 6 is, similarly to the intake passage 4, branches into four passages at an exhaust manifold, and is connected to the cylinder heads 3*c* via the exhaust manifold, for communication with the #1 to #4 cylinders 3*a*. Further, the engine 3 is provided with an exhaust-side valve-operating mechanism 11 for driving the exhaust valves 7. The exhaust-side valve-operating mechanism 11 is of a cam driven type including an exhaust cam (not shown) similarly to the intake-side valve-operating mechanism 10. The exhaust cam is connected to the crank shaft 3*e*, and rotates once whenever the crank shaft 3*e* rotates twice. The drive force of the crank shaft 3*e* is transmitted e.g. via the exhaust cam, whereby the exhaust valves 7 are opened and closed.

The fuel injection valves 8 are mounted on the intake manifold 4*a* in a manner facing respective intake ports 4*b* in the intake passage 4, and are connected to a fuel tank via a delivery pipe and a fuel pump (none of which are shown). Fuel in the fuel tank is supplied to the delivery pipe in a state pressurized by the fuel pump, and is stored in the delivery pipe. Then, the high-pressure fuel stored in the delivery pipe is supplied to the fuel injection valves 8, and is injected into each intake port 4*b* along with sequential opening of the associated fuel injection valve 8.

In this case, a fuel injection time period over which each fuel injection valve 8 is opened, and a fuel injection start timing in which fuel starts to be injected by the fuel injection valve 8 are controlled by inputting a control input signal from the ECU 2 to the fuel injection valve 8. Since the engine 3 is of a four-cycle type, fuel injection by the fuel injection valves 8 is performed for the #1 to #4 cylinders 3*a* in the order of #1→#3→#4→#2. Note that in FIG. 1, only one of the fuel injection valves, which is associated with the #1 cylinder 3*a*, is illustrated and denoted by the reference numeral 8, and the other fuel injection valves and their reference numerals 8 are omitted, for convenience sake.

Further, the delivery pipe is provided with a fuel pressure sensor 24, which detects a pressure PF of fuel in the delivery pipe (hereinafter referred to as the "fuel pressure"), and delivers a signal indicative of the sensed fuel pressure PF to the ECU 2. Note that the fuel pressure PF may be calculated according to a time which has elapsed from the start of driving the fuel pump and an amount of fuel discharged from the fuel pump, instead of detecting the same by the fuel pressure sensor 24.

Further, the fuel pump is formed by an electric pump, and the operation of the fuel pump is controlled by the ECU 2 according to a detection signal from a key switch 25. The key switch 25 detects an operation position (hereinafter referred to as the "key operation position") of an ignition key (not shown) of the vehicle, and delivers a signal indicative of a sensed key operation position to the ECU 2. When starting the engine 3, the ignition key is operated from an OFF position to an ON position and then to a START position in the mentioned order. The ECU 2 interrupts the fuel pump when the detected key operation position is the OFF position, and drives the same when the detected key operation position is the ON position or the START position.

Further, the spark plug 9 is connected to the ECU 2, and the ignition timing of the spark plug 9 is controlled by the ECU 2.

Further, a starter (not shown) for starting the engine 3 is connected to the crank shaft 3*e*. The starter is formed by an electric motor, and the operation of the starter is controlled by the ECU 2 according to the above-described key operation position. With this control, the starter is stopped when the key operation position is the OFF position or the ON position, and is operated when the key operation position is the START position. With this operation of the starter, the crank shaft 3*e* is driven, whereby cranking is performed.

The ECU 2 is implemented by a microcomputer comprising a CPU, a RAM, a ROM, and an I/O interface (none of which are specifically shown), and is stopped when the ignition key is in the OFF position, and is started when the ignition key is operated to the ON position. Further, the ECU 2 controls fuel injection by the fuel injection valves 8 according to a control program stored in the ROM based on the detection signals input from the above-mentioned various sensors 21 to 24, and the key switch 25.

Figure 3:
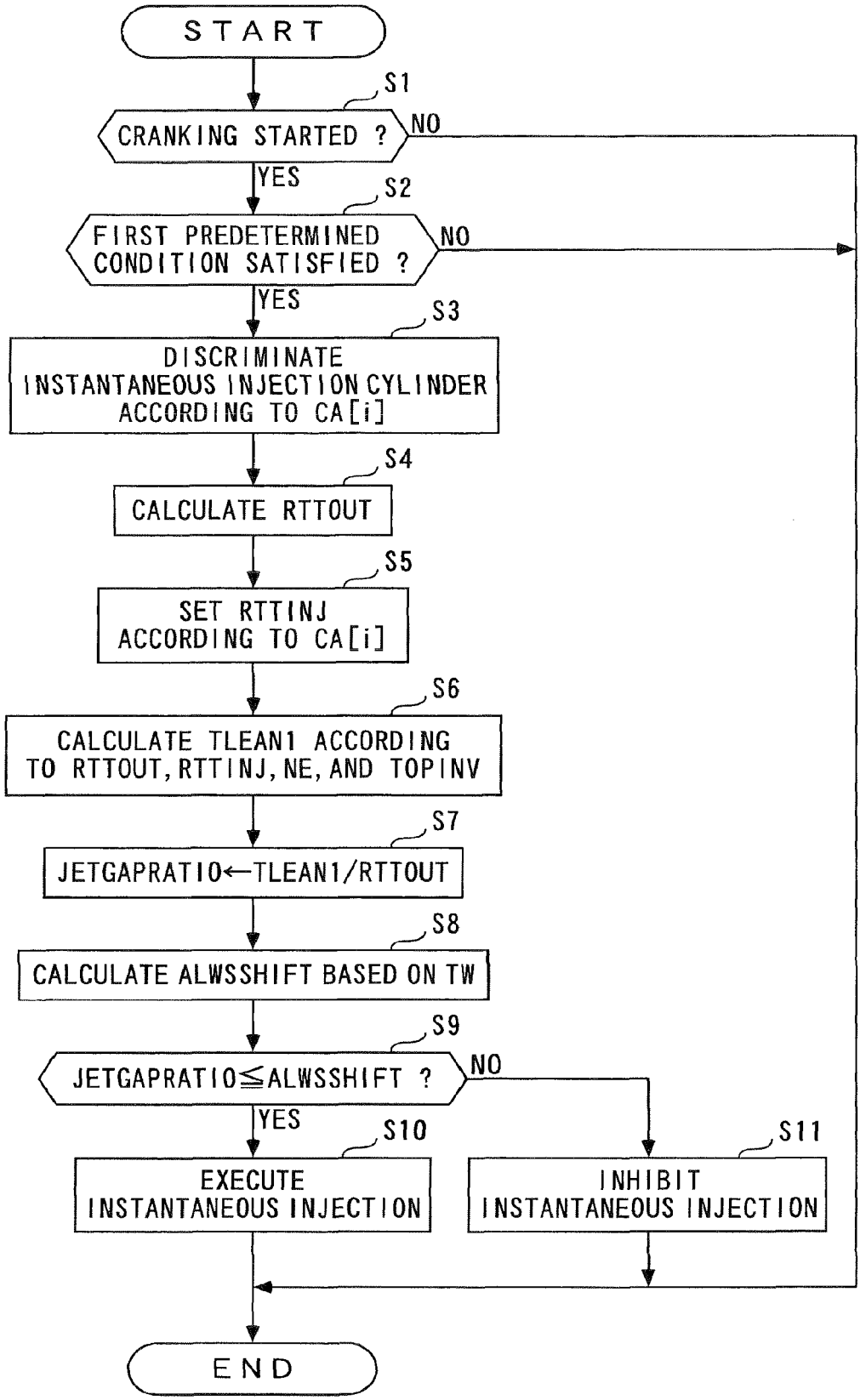
FIG. 3 is a flowchart of a process for controlling instantaneous injection executed when the engine is started.

Next, a description will be given of a process for controlling instantaneous injection executed when the engine 3 is started with reference to FIG. 3. The instantaneous injection is defined as instantaneous injection of fuel from the fuel injection valve 8 to a predetermined one of the cylinders 3*a* to which fuel is to be supplied when the engine 3 is started. The present process is started when the ignition key is operated from the OFF position to the ON position, and is repeatedly executed in synchronism with generation of the CRK signal.

First, in a step 1 (shown as S1 in abbreviated form in FIG. 3; the following steps are also shown in abbreviated form), it is determined based on the key operation position whether or not cranking has been started by the starter. If the answer to this question is negative (NO), i.e. if cranking has not been started yet, the present process is immediately terminated, whereas if the answer to this question is affirmative (YES), i.e. if cranking has been started, it is determined whether or not a first predetermined condition is satisfied (step 2).

Note that it is determined that the first predetermined condition is satisfied when both of following conditions (a) and (b) are satisfied:

(a) The detected fuel pressure PF is not lower than a predetermined value. The predetermined value is set to a level at which fuel injection by the fuel injection valve 8 can be executed.

(b) A crank angle position CA[i] is calculated for each cylinder 3*a*. Here, i represents a cylinder number value (i=one of 1 to 4) indicative of the number of the cylinders 3*a*.

The crank angle position CA[i] is calculated as follows: First, it is determined based on a pattern of a combination of rises and falls of the TDC signal whether or not any of the #1 to #4 cylinders 3*a* is at the start of the compression stroke. Then, based on the detection result and the CRK signal, the crank angle position CA [i] of the cylinder 3*a* determined as a cylinder which is at the start of the compression stroke (hereinafter referred to as the "discriminated cylinder") is calculated with reference to a point (=0°) at which the compression stroke is started.

Further, the crank angle position CA[i] of each of the other cylinders is calculated based on the calculated crank angle position CA[i] of the discriminated cylinder. For example, assuming that the discriminated cylinder is the #1 cylinder 3*a*, and one other cylinder is the #2 cylinder 3*a*, the crank angle position CA [2] of the #2 cylinder 3*a* is calculated by adding the crank angle 540° to the calculated crank angle position CA [1] of the #1 cylinder 3*a*. Further, the calculation of the crank angle positions CA [i] is started when the ignition key is operated from the OFF position to the ON position, and is repeatedly executed in synchronism with generation of the CRK signal.

Further, although the first predetermined condition is satisfied using a condition that the crank angle position CA[i] has been calculated, as on one of the conditions, as is clear from the above-mentioned method of calculating the crank angle position CA[i] according to the CRK signal etc., to calculate the crank angle position CA[i], it is necessary to rotate the crank shaft 3*e* to some extent by cranking by the starter. From the above, the first predetermined condition is satisfied after cranking has been performed to some extent.

If the answer to the question of the step 2 is negative (NO), the present process is immediately terminated, whereas if the answer to the question of the step 2 is affirmative (YES), i.e. if the above-mentioned first predetermined condition is satisfied, the instantaneous injection cylinder is discriminated according to the calculated crank angle position CA[i] (step 3). The instantaneous injection cylinder is the cylinder 3*a* for which instantaneous injection is executed, and in the step 3, one of the #1 to #4 cylinders 3*a*, for which the intake valve 5 is in the valve-closed state, and which is in the exhaust stroke or the expansion stroke, is discriminated as the instantaneous injection cylinder according to the crank angle positions CA[i] of each cylinder 3*a*.

Subsequently, an instantaneous injection time period RTTOUT is calculated according to the operating conditions of the engine 3, such as the detected engine coolant temperature TW (step 4). The instantaneous injection time period RTTOUT is a target value of the fuel injection time period over which fuel injection is to be performed by the instantaneous injection, and is calculated to a larger value as the engine coolant temperature TW is lower. Next, an instantaneous injection start timing RTTINJ is set according to the crank angle position CA[i] of the instantaneous injection cylinder discriminated in the step 3 (step 5). The instantaneous injection start timing RTTINJ is timing in which the instantaneous injection is to be started, and is set to the crank angle position CA[i] of the instantaneous injection cylinder at that time.

Figure 4:
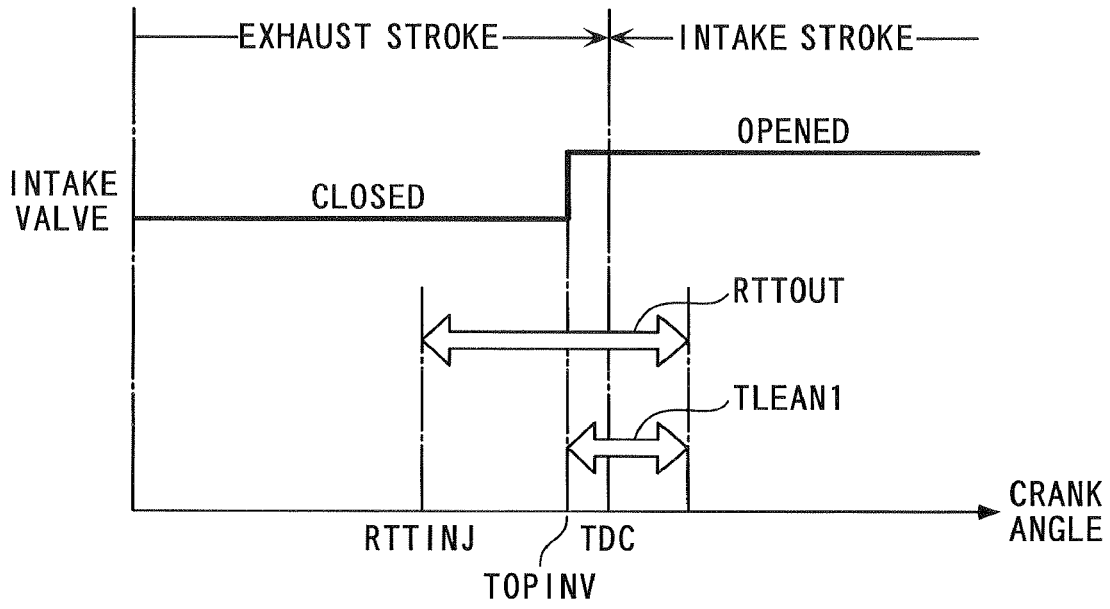
FIG. 4 is a diagram useful in explaining a first leaning time period calculated in the process shown in FIG. 3.

Subsequently, a first leaning time period TLEAN1 is calculated according to the instantaneous injection time period RTTOUT calculated in the step 4, the instantaneous injection start timing RTTINJ set in the step 5, the calculated engine speed NE, and the above-mentioned intake valve opening timing TOPINV (step 6). As shown in FIG. 4, the first leaning time period TLEAN1 is a time (time period) over which fuel is injected when the intake valve 5 of the instantaneous injection cylinder is opened, assuming that an amount of fuel corresponding to the instantaneous injection time period RTTOUT starts to be injected at the instantaneous injection start timing RTTINJ.

More specifically, in the step 6, the first leaning time period TLEAN1 is calculated as follows: First, the instantaneous injection time period RTTOUT in time units (msec.) is converted to a crank angle)(°) according to the engine speed NE. Subsequently, the value obtained by converting the instantaneous injection time period RTTOUT to the crank angle is added to the instantaneous injection start timing RTTINJ set to the crank angle positions CA[i] at the time, to thereby calculate instantaneous injection termination timing as the timing of termination of the instantaneous injection. Next, the intake valve opening timing TOPINV indicated by the crank angle position as mentioned above is subtracted from the calculated instantaneous injection termination timing, and a value thus obtained is converted to a time period (msec.) according to the engine speed NE, to thereby calculate the first leaning time period TLEAN1.

Subsequently, by dividing the calculated first leaning time period TLEAN1 by the instantaneous injection time period RTTOUT, a leaning influence ratio JETGAPRATIO is calculated (step 7). As is clear from the calculation method and what is described above as to the first leaning time period TLEAN1, the leaning influence ratio JETGAPRATIO is a ratio of a time period over which fuel is injected when the intake valve 5 of the instantaneous injection cylinder is opened to a fuel injection time period represented by the instantaneous injection time period RTTOUT.

Figure 5:
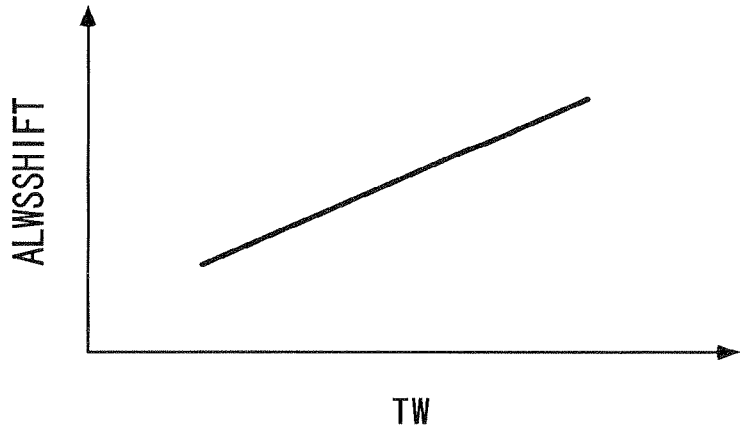
FIG. 5 is an example of a map used in the process in FIG. 3.

Next, a threshold value ALWSSHIFT is calculated based on the engine coolant temperature TW by searching a map shown in FIG. 5 (step 8). In this map, as the engine coolant temperature TW is higher, the threshold value ALWSSHIFT is set to a larger value for a reason described hereinafter.

Then, it is determined whether or not the leaning influence ratio JETGAPRATIO calculated in the step 7 is not larger than the threshold value ALWSSHIFT calculated in the step 8 (step 9). If the answer to this question is affirmative (YES), the instantaneous injection is executed for the instantaneous injection cylinder discriminated in the step 3 (step 10), followed by terminating the present process. Along with execution of the step 10, the control input signal based on the instantaneous injection start timing RTTINJ and the instantaneous injection time period RTTOUT is input to the fuel injection valve 8 associated with the instantaneous injection cylinder. With this operation, the injection start timing and the fuel injection time period of the fuel injection valve 8 are controlled to the instantaneous injection start timing RTTINJ and the instantaneous injection time period RTTOUT, respectively, and as a result, the fuel is injected to the instantaneous injection cylinder.

On the other hand, if the answer to the question of the step 9 is negative (NO), i.e. if the leaning influence ratio JETGAPRATIO is larger than the threshold value ALWSSHIFT, it is predicted that a ratio of an amount of fuel flowing into the instantaneous injection cylinder without being vaporized to the amount of fuel injected by the instantaneous injection, becomes large, or a ratio of an amount of fuel which does not flow into the instantaneous injection cylinder to the amount of the fuel injected by the instantaneous injection becomes large, which can make it impossible to properly burn vaporized fuel without causing a misfire, so that the instantaneous injection is inhibited (step 11), followed by terminating the present process. Note that if the step 10 or 11 is executed, the present process is not executed again thereafter during the current operation of the engine 3.

Further, the threshold value ALWSSHIFT is set according to the engine coolant temperature TW as mentioned above for the following reason: As the engine coolant temperature TW is higher, the fuel is more likely to vaporize, and hence the threshold value ALWSSHIFT to a larger value so as not to inhibit the instantaneous injection but to execute the same.

Note that as the engine coolant temperature TW is lower, the instantaneous injection time period RTTOUT is calculated to a larger value as mentioned above (step 4), and hence the ratio of the time period during which the vaporized fuel becomes lean to the fuel injection time period represented by the instantaneous injection time period RTTOUT becomes smaller. For this reason, when the engine coolant temperature TW is in a very low temperature range, the threshold value ALWSSHIFT may be set such that gradient of the threshold value ALWSSHIFT with respect to the engine coolant temperature TW is smaller than that when the engine coolant temperature TW is in a higher temperature range, and becomes even smaller as the engine coolant temperature TW becomes lower.

Note that out of the #1 to #4 cylinders 3*a*, for the cylinders 3*a* other than the instantaneous injection cylinder, fuel injection by the fuel injection valve 8 is performed in a predetermined timing in the exhaust stroke.

Note that the first embodiment corresponds to the invention according to claims 1 and 3 of claims appended thereto (hereinafter collectively referred to as the "first invention"), and the correspondence relationship between the various elements in the first embodiment and those in the first invention is as follows: The coolant temperature sensor 22 in the first embodiment corresponds to engine temperature-detecting means in the first invention, and the ECU 2 in the first embodiment corresponds to predetermined condition-determining means, instantaneous injection-executing means, instantaneous injection time period-setting means, leaning influence ratio-estimating means, threshold value-setting means, and instantaneous injection-inhibiting means in the first invention. Further, the engine coolant temperature TW, the instantaneous injection time period RTTOUT, and the instantaneous injection start timing RTTINJ in the first embodiment correspond to temperature of the engine, the instantaneous injection time period, and a timing in which the instantaneous injection is executed, in the first invention, respectively.

As described above, according to the first embodiment, after cranking of the engine 3 is started, immediately when the first predetermined condition is satisfied, the instantaneous injection is executed for the instantaneous injection cylinder (step 10 in FIG. 3), and hence it is possible to supply fuel to the instantaneous injection cylinder immediately when the engine 3 is started, and therefore, it is possible to promptly start the engine 3.

Further, as described above, since the first predetermined condition is satisfied after the crank shaft 3*e* is rotated to some extent by cranking, at a time point when the first predetermined condition is satisfied, the intake operation has been repeated several times. Therefore, even when the intake operation of the instantaneous injection cylinder has not been performed yet because of the instantaneous injection cylinder being in the exhaust stroke, if only the intake valve 5 starts to be opened, fresh air within the intake passage 4 immediately flows into the instantaneous injection cylinder by inertia.

In view of this, according to the first embodiment, for the instantaneous injection cylinder, the cylinder 3*a* is used for which the intake valve 5 is in the closed state when the first predetermined condition is satisfied (step 3), and hence it is possible to properly supply fuel by the instantaneous injection to the instantaneous injection cylinder in a sufficiently vaporized state. Further, in this case, since the cylinder 3*a* in the exhaust stroke or the expansion stroke is used for the instantaneous injection cylinder, it is possible to make earlier a first expansion in the instantaneous injection cylinder, compared with a case where the cylinder 3*a* in the compression stroke is used, which makes it possible to more promptly start the engine 3.

Further, since when the calculated leaning influence ratio JETGAPRATIO is larger than the threshold value ALWSSHIFT, the instantaneous injection is inhibited (steps 9 and 11), it is possible to inhibit the instantaneous injection if the ratio of fuel flowing into the predetermined cylinder without being vaporized to the fuel injected by the instantaneous injection is relatively large or if the ratio of fuel which does not flow into the predetermined cylinder to the same is relatively large, and execute the instantaneous injection in the other cases. This makes it possible to properly burn vaporized fuel without causing a misfire in the predetermined cylinder differently from the above-described conventional fuel injection control system, and therefore it is possible to properly reduce exhaust emissions.

Further, in inhibition of the instantaneous injection, differently from the above-described conventional fuel injection control system, the time period during which the vaporized fuel becomes lean is not directly used, but the leaning influence ratio JETGAPRATIO is used, and hence it is possible to properly inhibit the instantaneous injection according to the actual ratio of the time period during which the vaporized fuel becomes lean to the fuel injection time period represented by the instantaneous injection time period RTTOUT (hereinafter referred to as the "instantaneous injection time period"). In addition, since the threshold value ALWSSHIFT is set according to the detected engine coolant temperature TW (step 8), it is possible to properly inhibit the instantaneous injection according the actual temperature of the engine 3 at the time, and it is possible to properly perform prompt starting of the engine 3, thanks to the combined effect of the use of the leaning influence ratio JETGAPRATIO.

Further, as described above, fresh air within the intake passage 4 immediately flows into the instantaneous injection cylinder if only the intake valve 5 starts to be opened. In view of this, according to the first embodiment, the ratio of the time period over which fuel is injected when the intake valve 5 of the instantaneous injection cylinder is opened to the instantaneous injection time period is calculated as the leaning influence ratio JETGAPRATIO (step 7). Therefore, it is possible to properly estimate the leaning influence ratio JETGAPRATIO to indicate the ratio of the time period during which the vaporized fuel becomes lean to the instantaneous injection time period, and in turn it is possible to more properly inhibit the instantaneous injection.

Further, since the instantaneous injection time period RTTOUT and the instantaneous injection start timing RTTINJ are used as parameters for calculating the leaning influence ratio JETGAPRATIO (steps 6 and 7), it is possible to properly calculate the leaning influence ratio JETGAPRATIO according to the time period over which fuel is actually injected by the instantaneous injection and the actual start timing of the instantaneous injection, and in turn, it is possible to further properly inhibit the instantaneous injection.

Although in the first embodiment, the cylinder 3*a* for which the intake valve 5 is in the valve-closed state when the first predetermined condition is satisfied, and which is in the exhaust stroke or the expansion stroke is used for the instantaneous injection cylinder, the cylinder 3*a* in the compression stroke may be used insofar as it is one for which the intake valve 5 is in the valve-closed state when the first predetermined condition is satisfied. Further, the plurality of cylinders 3*a* may be used for the instantaneous injection cylinders insofar as they satisfy the condition that "when the first predetermined condition is satisfied, the intake valve 5 is in the valve-closed state".

Further, although in the first embodiment, the value obtained by dividing the first leaning time period TLEAN1 by the instantaneous injection time period RTTOUT (TLEAN1/RTTOUT) is used as the leaning influence ratio JETGAPRATIO, any other suitable parameter representative of a ratio of the first leaning time period TLEAN1 to the instantaneous injection time period RTTOUT may be used. For example:

A. inversely to the above, a value obtained by dividing the instantaneous injection time period RTTOUT by the first leaning time period TLEAN1 (RTTOUT/TLEAN1);

B. a value obtained by dividing a value obtained by subtracting the first leaning time period TLEAN1 from the instantaneous injection time period RTTOUT by the instantaneous injection time period RTTOUT [(RTTOUT−TLEAN1)/RTTOUT]; and C. the reciprocal of the value of the above B [RTTOUT/(RTTOUT−TLEAN1)].

Figure 6:
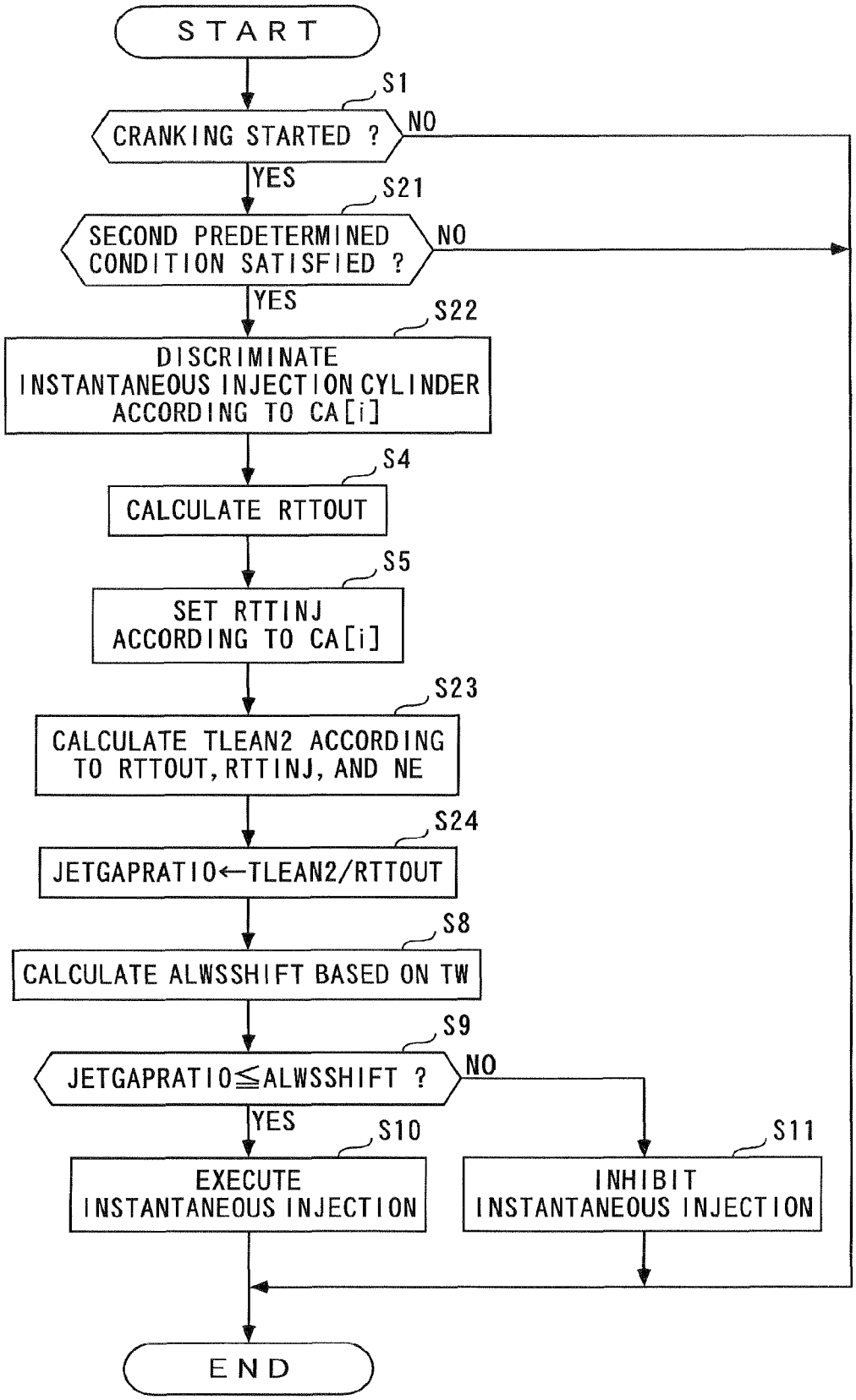
FIG. 6 is a flowchart of a process for controlling instantaneous injection, which is executed by a fuel injection control system according to a second embodiment of the present invention.

Next, a description will be given of a fuel injection control system according to a second embodiment of the present invention. This fuel injection control system differs from that in the first embodiment mainly in that the leaning influence ratio JETGAPRATIO is calculated according to the instantaneous injection time period (fuel injection time period represented by the instantaneous injection time period RTTOUT) and a time period over which fuel is injected in the intake stroke of the instantaneous injection cylinder. FIG. 6 shows a process for controlling instantaneous injection, which is executed by the fuel injection control system according to the second embodiment. Note that in FIG. 6, steps identical to those of the process in the first embodiment are designated by the same step numbers. Hereafter, the following description is given mainly of different steps from those in the first embodiment with reference to FIG. 6.

If the answer to the question of the step 1 is affirmative (YES), it is determined whether or not a second predetermined condition is satisfied (step 21). The second predetermined condition is satisfied when only the condition (a) concerning the above-mentioned fuel pressure PF is satisfied. This is for the following reason: In the second embodiment, differently from the first embodiment, the ECU 2 has a non-volatile memory such as an EEPROM. The crank angle position CA[i] is stored in the non-volatile memory when the engine 3 is stopped, and is calculated using the stored crank angle position CA[i] when the engine 3 is started thereafter. From the above, in the second embodiment, when the engine 3 is started, it is not necessary to wait for the condition (b) to be satisfied, i.e. the crank angle position CA[i] to be calculated according the CRK signal, etc.

Further, as described above, the fuel pressure PF is increased by the electrical pump which is started when the ignition key is operated from the OFF position to the ON position. Furthermore, cranking by the starter is started when the ignition key is operated from the ON position to the START position. From the above, the second predetermined condition which is satisfied only by the condition (a) concerning the fuel pressure PF is sometimes satisfied almost simultaneously when cranking is started.

If the answer to the question of the step 21 is negative (NO), the present process is immediately terminated, whereas if the answer to this question is affirmative (YES), i.e. if the above-mentioned second predetermined condition is satisfied, the instantaneous injection cylinder is discriminated according to the crank angle position CA[i] (step 22), and the step 4 et seq. is executed. In the step 22, differently from the first embodiment, one of the #1 to #4 cylinders 3*a*, which is in the exhaust stroke, is discriminated as the instantaneous injection cylinder according to the crank angle position CA[i].

Figure 7:
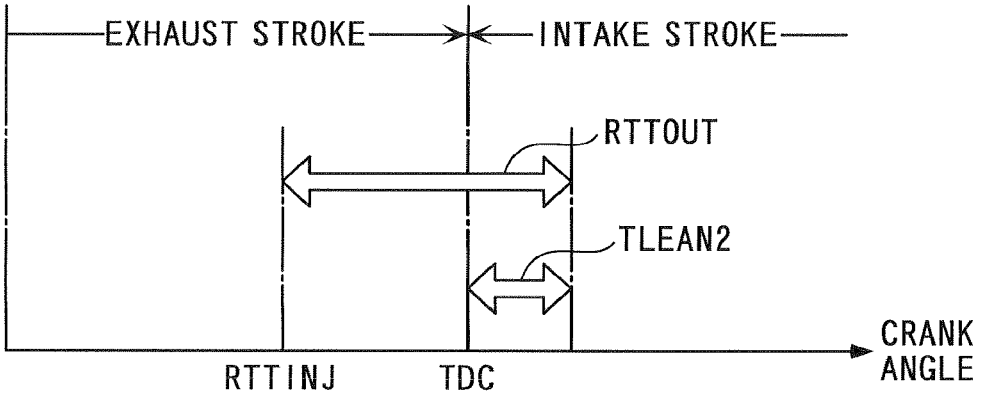
FIG. 7 is a diagram useful in explaining a second leaning time period calculated in the process shown in FIG. 6.

In a step 23 following the step 5, a second leaning time period TLEAN2 is calculated according to the instantaneous injection time period RTTOUT, the instantaneous injection start timing RTTINJ, and the engine speed NE. As shown in FIG. 7, the second leaning time period TLEAN2 is a time (time period) over which fuel is injected during the intake stroke of the instantaneous injection cylinder, assuming that an amount of fuel corresponding to the instantaneous injection time period RTTOUT starts to be injected at the instantaneous injection start timing RTTINJ.

In the step 23, the second leaning time period TLEAN2 is specifically calculated as follows: First, the instantaneous injection time period RTTOUT in time units (msec.) is converted to a crank angle)(°) according to the engine speed NE. Subsequently, the value obtained by converting the instantaneous injection time period RTTOUT to the crank angle is added to the instantaneous injection start timing RTTINJ set to the crank angle position CA[i] at the time, to thereby calculate the instantaneous injection termination timing as the timing of termination of the instantaneous injection. Further, since the crank angle position CA[i] is calculated with reference to the point (time point) at which the compression stroke is started, as mentioned hereinabove, when the start time of the intake stroke is converted to the crank angle position CA[i], the start time of the intake stroke is obtained as CA=540°. Next, a value obtained by subtracting the value (CA=540°) obtained by converting the start time of the intake stroke from the calculated instantaneous injection termination timing is converted to a time period (msec.) according to the engine speed NE to thereby calculate the second leaning time period TLEAN2.

Subsequently, by diving the second leaning time period TLEAN2 calculated in the step 23 by the instantaneous injection time period RTTOUT, the leaning influence ratio JETGAPRATIO is calculated (step 24). As is clear from the calculation method and what is described above as to the second leaning time period TLEAN2, the leaning influence ratio JETGAPRATIO is a ratio of a time period over which fuel is injected during the intake stroke of the instantaneous injection cylinder to the instantaneous injection time period (fuel injection time period represented by the instantaneous injection time period RTTOUT).

Further, by executing the step 8 et seq. following the step 24, the instantaneous injection is executed or inhibited, followed by terminating the present process. Note that also in the second embodiment, similarly to the first embodiment, when the step 10 or 11 is executed to execute or inhibit the instantaneous injection, the present process is not executed again thereafter during the current operation of the engine 3.

Note that the second embodiment corresponds to the invention according to claims 1 and 2 of the claims appended thereto (hereinafter collectively referred to as the "second invention"), and the correspondence relationship between the various elements in the second embodiment and those in the second invention is as follows: The coolant temperature sensor 22 in the second embodiment corresponds to engine temperature-detecting means in the second invention, and the ECU 2 in the second embodiment corresponds to predetermined condition-determining means, instantaneous injection-executing means, instantaneous injection time period-setting means, leaning influence ratio-estimating means, threshold value-setting means, and instantaneous injection-inhibiting means in the second invention. Further, the engine coolant temperature TW, the instantaneous injection time period RTTOUT, and the instantaneous injection start timing RTTINJ in the second embodiment correspond to temperature of the engine, the instantaneous injection time period, and timing in which the instantaneous injection is executed in the second invention.

As described above, according to the second embodiment, after cranking of the engine 3 is started, immediately when the second predetermined condition is satisfied, the instantaneous injection is executed for the instantaneous injection cylinder (step 10 in FIG. 6), and hence it is possible to supply fuel to the instantaneous injection cylinder immediately when the engine 3 is started, and therefore, it is possible to promptly start the engine 3.

Further, as described above, differently from the first embodiment, the second predetermined condition is sometimes satisfied almost simultaneously when cranking is started. In this case, at a time point when the second predetermined condition is satisfied, cranking has been hardly repeated, whereby the intake operation has also been hardly repeated. As a result, differently from the first embodiment, merely opening the intake valve 5 does not cause fresh air within the intake passage 4 to flow into the instantaneous injection cylinder, but the fresh air flows into the instantaneous injection cylinder only after the intake operation is actually performed in the instantaneous injection cylinder.

To cope with this, according to the second embodiment, the cylinder 3*a* which is in the exhaust stroke before the intake stroke when the second predetermined condition is satisfied is used for the instantaneous injection cylinder (step 22), and hence it is possible to properly supply fuel to the instantaneous injection cylinder in a state where the fuel is sufficiently vaporized. For the same reason, compared with a case where the cylinder 3*a* in the compression stroke or the expansion stroke is used as the instantaneous injection cylinder, it is possible to make earlier a first expansion in the instantaneous injection cylinder, which makes it possible to more promptly start the engine 3.

Further, as described above, fresh air within the intake passage 4 flows into the instantaneous injection cylinder only after the intake operation is actually performed. In view of this, according to the second embodiment, the ratio of the time period over which fuel is injected during the intake stroke of the instantaneous injection cylinder to the fuel injection time period represented by the instantaneous injection time period RTTOUT is calculated as the leaning influence ratio JETGAPRATIO (steps 23 and 24). Therefore, it is possible to properly estimate the leaning influence ratio JETGAPRATIO such that it represents the ratio of the time period during which vaporized fuel becomes lean to the instantaneous injection time period.

Further, the inhibition of the instantaneous injection based on the comparison result of the leaning influence ratio JETGAPRATIO and the threshold value ALWSSHIFT and the calculation of the threshold value ALWSSHIFT based on the engine coolant temperature TW are performed similarly to the first embodiment. Therefore, it is possible to similarly obtain the same advantageous effects as provided by the first embodiment, i.e. it is possible to properly reduce exhaust emissions at the start of the engine 3, and it is possible to properly perform prompt starting of the engine 3.

Note that although in the second embodiment, the value obtained by dividing the second leaning time period TLEAN2 by the instantaneous injection time period RTTOUT (TLEAN2/RTTOUT) is used as the leaning influence ratio JETGAPRATIO, any other suitable parameter indicative of the ratio of the second leaning time period TLEAN2 to the instantaneous injection time period RTTOUT may be used. For example:

A. inversely to the above, a value obtained by dividing the instantaneous injection time period RTTOUT by the second leaning time period TLEAN2 (RTTOUT/TLEAN2);

B. a value obtained by dividing a value obtained by subtracting the second leaning time period TLEAN2 from the instantaneous injection time period RTTOUT by the instantaneous injection time period RTTOUT [(RTTOUT−TLEAN2)/RTTOUT]; and C. the reciprocal of the value of the above B [RTTOUT/(RTTOUT−TLEAN2)].

Figure 8:
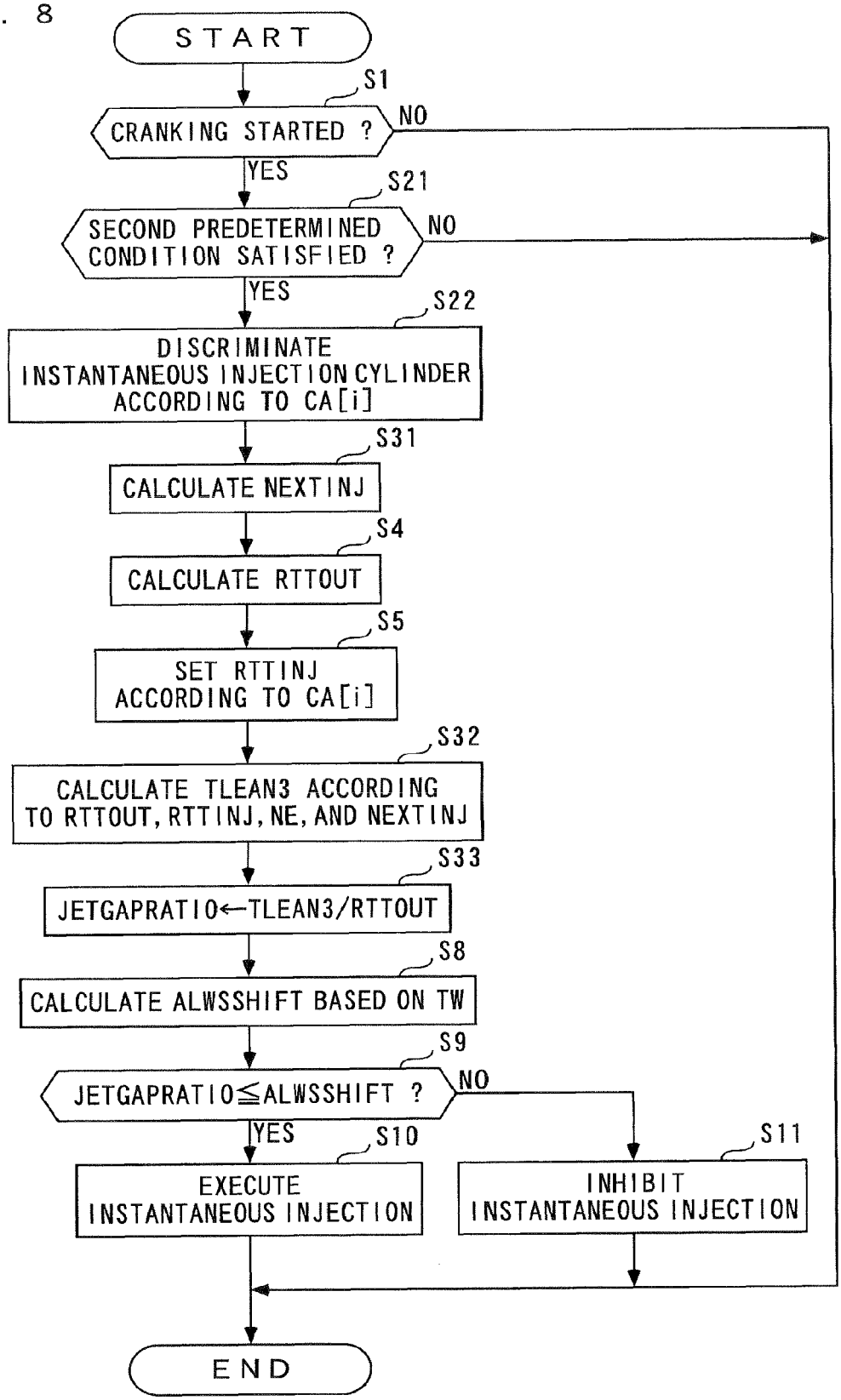
FIG. 8 is a flowchart of a process for controlling instantaneous injection, which is executed by a fuel injection control system according to a third embodiment of the present invention.

Next, a description will be given of a fuel injection control system according to a third embodiment of the present invention. This fuel injection control system differs from the first and second embodiments mainly in steps of the process for controlling the instantaneous injection. FIG. 8 shows a process for controlling instantaneous injection, which is executed by the fuel injection control system according to the third embodiment. Note that in FIG. 8, steps identical to those of the process in the first and second embodiments are designated by the same step numbers. Hereafter, the following description is given mainly of different steps from those in the first and second embodiments with reference to FIG. 8.

In a step 31 following the step 22, a next cylinder injection start timing NEXTINJ is calculated, and then the step 4 et seq. is executed. The next cylinder injection start timing NEXTINJ is timing of start of fuel injection to a cylinder to which fuel is to be supplied next to the instantaneous injection cylinder (hereinafter referred to as the "next cylinder"), and is calculated according to the operating conditions of the engine 3, such as the engine coolant temperature TW. In this case, the next cylinder injection start timing NEXTINJ is represented by a crank angle position with reference to a reference point of the start time of the compression stroke of the instantaneous injection cylinder.

Figure 9:
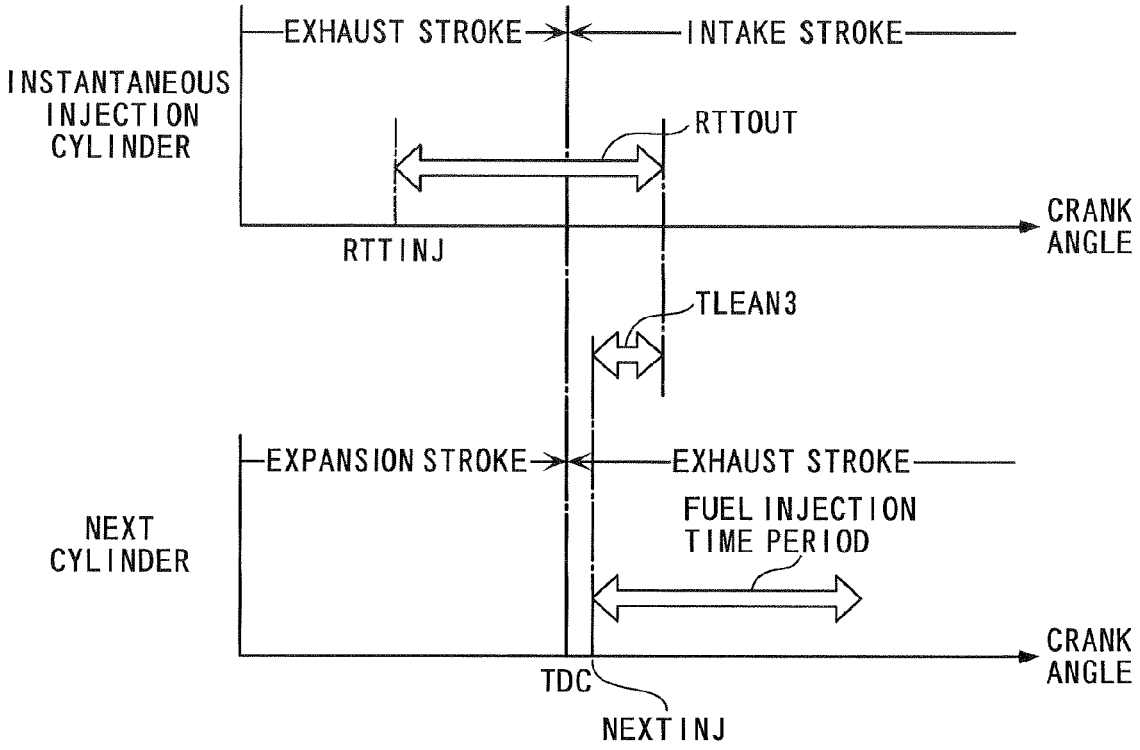
FIG. 9 is a diagram useful in explaining a third leaning time period calculated in the process in FIG. 8.

In a step 32 following the step 5, a third leaning time period TLEAN3 is calculated according to the instantaneous injection start timing RTTINJ, the instantaneous injection time period RTTOUT, the engine speed NE, and the next cylinder injection start timing NEXTINJ calculated in the step 31. As shown in FIG. 9, the third leaning time period TLEAN3 is a time (time period) during which the instantaneous injection overlaps fuel injection to the next cylinder, assuming that an amount of fuel corresponding to the instantaneous injection time period RTTOUT starts to be injected at the instantaneous injection start timing RTTINJ.

In the step 32, the third leaning time period TLEAN3 is specifically calculated as follows: First, the instantaneous injection time period RTTOUT in time units (msec.) is converted to a crank angle (°) according to the engine speed NE. Next, the value obtained by converting the instantaneous injection time period RTTOUT to the crank angle is added to the instantaneous injection start timing RTTINJ set to the crank angle position CA[i] at the time to thereby calculate the instantaneous injection termination timing as the timing of termination of the instantaneous injection. Next, the next cylinder injection start timing NEXTINJ represented by the crank angle position CA[i] of the instantaneous injection cylinder is subtracted from the calculated instantaneous injection termination timing, and a thus obtained value is converted to a time period (msec.) according to the engine speed NE to thereby calculate the third leaning time period TLEAN3.

Then, by diving the third leaning time period TLEAN3 calculated in the step 32 by the instantaneous injection time period RTTOUT, the leaning influence ratio JETGAPRATIO is calculated (step 33). As is clear from the calculation method and what is described above as to the third leaning time period TLEAN3, the leaning influence ratio JETGAPRATIO is a ratio of the time period during which the instantaneous injection overlaps the fuel injection to the next cylinder to the instantaneous injection time period (fuel injection time period represented by the instantaneous injection time period RTTOUT).

Further, by executing the step 8 et seq. following the step 33, the instantaneous injection is executed or inhibited, followed by terminating the present process. Note that also in the third embodiment, similarly to the first embodiment, when the step 10 or 11 is executed to execute or inhibit the instantaneous injection, the present process is not executed again thereafter during the current operation of the engine 3.

Note that the third embodiment corresponds to the invention according to claims 1 and 4 of the claims appended hereto (hereinafter collectively referred to as the "third invention"), and the correspondence relationship between the various elements in the third embodiment and those in the third invention is as follows: The coolant temperature sensor 22 in the third embodiment corresponds to engine temperature-detecting means in the third invention, and the ECU 2 in the third embodiment corresponds to predetermined condition-determining means, instantaneous injection-executing means, instantaneous injection time period-setting means, leaning influence ratio-estimating means, threshold value-setting means, instantaneous injection-inhibiting means, and next cylinder injection start timing-setting means in the third invention. Further, the engine coolant temperature TW and the instantaneous injection time period RTTOUT in the third embodiment correspond to temperature of the engine and the instantaneous injection time period in the third invention, respectively.

As described above, according to the third embodiment, similarly to the second embodiment, after cranking of the engine 3 is started, immediately when the second predetermined condition is satisfied, the instantaneous injection is executed for the instantaneous injection cylinder (step 10 in FIG. 8), and hence it is possible to supply fuel to the instantaneous injection cylinder immediately when the engine 3 is started, and therefore, it is possible to promptly start the engine 3. Further, the cylinder 3*a* which is in the exhaust stroke when the second predetermined condition is satisfied is used for the instantaneous injection cylinder (step 22), and hence it is possible to properly supply fuel to the instantaneous injection cylinder by the instantaneous injection in a sufficiently vaporized state, and it is possible to more promptly start the engine 3.

Further, the leaning influence ratio JETGAPRATIO is estimated as the ratio of the time period during which the instantaneous injection overlaps fuel injection to the next cylinder to the instantaneous injection time period (steps 32 and 33), and hence it is possible to properly estimate the leaning influence ratio JETGAPRATIO such that it represents the ratio of the time period during which the vaporized fuel becomes lean to the instantaneous injection time period.

Further, since the instantaneous injection time period RTTOUT and the next cylinder injection start timing NEXTINJ are used as the parameters for calculating the leaning influence ratio JETGAPRATIO (steps 32 and 33), it is possible to properly calculate the leaning influence ratio JETGAPRATIO according to the time period over which fuel is actually injected by the instantaneous injection and the actual start timing of the fuel injection to the next cylinder.

Further, the inhibition of the instantaneous injection based on the comparison result of the leaning influence ratio JETGAPRATIO and the threshold value ALWSSHIFT and the calculation of the threshold value ALWSSHIFT based on the engine coolant temperature TW are performed similarly to the first embodiment. Therefore, it is possible to similarly obtain the same advantageous effects as provided by the first embodiment, i.e. it is possible to properly reduce exhaust emissions at the start of the engine 3, and it is possible to properly perform early starting of the engine 3.

Note that although in the third embodiment, the value obtained by dividing the third leaning time period TLEAN3 by the instantaneous injection time period RTTOUT (TLEAN3/RTTOUT) is used as the leaning influence ratio JETGAPRATIO, any other suitable parameter indicative of the ratio of the third leaning time period TLEAN3 to the instantaneous injection time period RTTOUT may be used. For example:

A. inversely to the above, a value obtained by dividing the instantaneous injection time period RTTOUT by the third leaning time period TLEAN3 (RTTOUT/TLEAN3);

B. a value obtained by dividing a value obtained by subtracting the third leaning time period TLEAN3 from the instantaneous injection time period RTTOUT by the instantaneous injection time period RTTOUT [(RTTOUT−TLEAN3)/RTTOUT]; and C. the reciprocal of the value of the above B [RTTOUT/(RTTOUT−TLEAN3)].

Further, although in the second and third embodiments, the cylinder 3*a* which is in the exhaust stroke when the second predetermined condition is satisfied is used for the instantaneous injection cylinder, the cylinder 3*a* in a stroke other than the intake stroke, e.g. in the compression stroke or the expansion stroke when the second predetermined condition is satisfied may be used. Further, the plurality of cylinder 3*a* may be used for the instantaneous injection cylinders insofar as they satisfy a condition that "when the second predetermined condition is satisfied, the cylinder is in a stroke other than the intake stroke".

Note that the present invention is by no means limited to the first to third embodiments described above (hereinafter collectively referred to as the "embodiment"), but it can be practiced in various forms. For example, although in the embodiment, the engine coolant temperature TW which is temperature of engine coolant of the engine 3 is used as a parameter for calculating the threshold value ALWSSHIFT, any other suitable parameter indicative of the temperature of the engine 3 may be used. For example, temperature of lubricant of the engine 3, temperature of a wall of the cylinder 3*a*, or temperature of intake air in a portion of the intake passage 4 in the vicinity of the engine 3, i.e. in the intake manifold 4*a* or the intake port 4*b* may be used.

Further, although in the embodiment, in the control of the instantaneous injection, the instantaneous injection start timing RTTINJ is set and the timing of start of the instantaneous injection is controlled to the set instantaneous injection start timing RTTINJ, this is not limitative, but the timing of termination of the instantaneous injection may be controlled to a set timing. In this case, the set timing of termination of the instantaneous injection is used for calculation of the above-mentioned first to third leaning time periods TLEAN1 to TLEAN3, in place of the instantaneous injection start timing RTTINJ.

Further, although in the embodiment, the present invention is applied to the engine 3 of a so-called port injection type, by way of example, it can be applied to an engine of an in-cylinder injection type that directly injects fuel into the cylinders 3*a*. In this case, when fuel is injected to a next cylinder during execution of the instantaneous injection for the instantaneous injection cylinder, the fuel pressure is reduced, whereby the amount of vaporized fuel actually supplied to the instantaneous injection cylinder decreases, so that the instantaneous injection is controlled by the method described in the third embodiment. Further, the present invention can be applied not only to the engine 3 as a gasoline engine, but also to various industrial engines, such as a diesel engine, an LPG engine, and ship propulsion machines, such as an outboard motor having a vertically-disposed crankshaft.

It is further understood by those skilled in the art that the foregoing are preferred embodiments of the invention, and that various changes and modifications may be made without departing from the spirit and scope thereof.

What is claimed is:

1. A fuel injection control method for an internal combustion engine in which fuel injected by fuel injection valves provided for cylinders respectively is supplied to the cylinders, comprising:

detecting temperature of the engine;

determining whether or not a predetermined condition necessary for injecting fuel from the fuel injection valves is satisfied;

executing instantaneous injection when it is determined that the predetermined condition is satisfied after cranking of the engine is started except when the instantaneous injection is inhibited, the instantaneous injection performed by injecting fuel from one of the fuel injection valves corresponding to a predetermined cylinder for which fuel is to be supplied when the predetermined condition is satisfied;

setting a next cylinder injection start timing which is timing of start of fuel injection by the fuel injection valve for a next cylinder of the plurality of cylinders to which fuel is injected next to the predetermined cylinder;

calculating a parameter indicative of a ratio of a time period during which the instantaneous injection overlaps the fuel injection to the next cylinder to the instantaneous injection time period, according to the instantaneous injection time period and the set next cylinder injection start timing, as a leaning influence ratio;

setting a threshold value based on the detected temperature of the engine; and inhibiting the instantaneous injection when the calculated leaning influence ratio is larger than the set threshold value, wherein the fuel injection valve for the predetermined cylinder injects an entirety of the fuel for the predetermined cylinder during each cycle of the internal combustion engine.

2. The fuel injection control method as claimed in claim 1, wherein the fuel injection valves are disposed so as to inject the fuel directly into the respective cylinders.

3. The fuel injection control method as claimed in claim 2, wherein, when executing instantaneous injection is performed, fuel is injected instantaneously when it is determined that the predetermined condition is satisfied, and wherein, when inhibiting the instantaneous injection, the instantaneous injection is not performed during starting of the internal combustion engine.

4. A fuel injection control method for an internal combustion engine in which fuel injected into an intake passage including intake ports of the engine by fuel injection valves is supplied to cylinders, comprising:

detecting temperature of the engine;

determining whether or not a predetermined condition necessary for injecting fuel from the fuel injection valves is satisfied;

executing instantaneous injection when it is determined that the predetermined condition is satisfied after cranking of the engine is started except when the instantaneous injection is inhibited, the instantaneous injection performed by injecting fuel from one of the fuel injection valves for a predetermined cylinder for which an associated intake valve of the engine is in a valve-closed state when the predetermined condition is satisfied;

setting an instantaneous injection time period which is a time period over which fuel is to be injected by the instantaneous injection;

calculating a parameter indicative of a ratio of a time period over which fuel is injected when the intake valve associated with the predetermined cylinder is opened to the instantaneous injection time period, according to the instantaneous injection time period and timing in which the instantaneous injection is executed, as a leaning influence ratio;

setting a threshold value based on the detected temperature of the engine; and inhibiting the instantaneous injection when the calculated leaning influence ratio is larger than the set threshold value, wherein the fuel injection valve for the predetermined cylinder injects an entirety of the fuel for the predetermined cylinder during each cycle of the internal combustion engine, wherein the fuel injection valves are each disposed so as to inject the fuel in a direction toward a respective intake port of the intake passage, wherein, when executing instantaneous injection is performed, fuel is injected instantaneously when it is determined that the predetermined condition is satisfied in a direction toward the associated intake valve of the engine that is in the valve-closed state, and wherein, when inhibiting the instantaneous injection, the instantaneous injection is not performed during starting of the internal combustion engine.

5. A fuel injection control method for an internal combustion engine in which fuel injected into an intake passage including intake ports of the engine by fuel injection valves is supplied to cylinders, comprising:

detecting temperature of the engine;

determining whether or not a predetermined condition necessary for injecting fuel from the fuel injection valves is satisfied;

executing instantaneous injection when it is determined that the predetermined condition is satisfied after cranking of the engine is started except when the instantaneous injection is inhibited, the instantaneous injection performed by injecting fuel from one of the fuel injection valves for a predetermined cylinder which is in a stroke other than an intake stroke of the engine when the predetermined condition is satisfied;

setting an instantaneous injection time period which is a time period over which fuel is to be injected by the instantaneous injection;

calculating a parameter indicative of a ratio of a time period over which fuel is injected during the intake stroke of the predetermined cylinder to the instantaneous injection time period, according to the instantaneous injection time period and timing in which the instantaneous injection is executed, as a leaning influence ratio;

setting a threshold value based on the detected temperature of the engine; and inhibiting the instantaneous injection when the calculated leaning influence ratio is larger than the set threshold value, wherein the fuel injection valve for the predetermined cylinder injects an entirety of the fuel for the predetermined cylinder during each cycle of the internal combustion engine, wherein the fuel injection valves are each disposed so as to inject the fuel in a direction toward a respective intake port of the intake passage, wherein, when executing instantaneous injection is performed, fuel is injected instantaneously when it is determined that the predetermined condition is satisfied in a direction toward the associated intake valve of the engine, and wherein, when inhibiting the instantaneous injection, the instantaneous injection is not performed during starting of the internal combustion engine.

* * * * *